US008677554B2

(12) United States Patent
Conrad

(10) Patent No.: US 8,677,554 B2
(45) Date of Patent: Mar. 25, 2014

(54) VALVE FOR A SURFACE CLEANING APPARATUS

(75) Inventor: Wayne Ernest Conrad, Hampton (CA)

(73) Assignee: G.B.D. Corp., Nassau (BS)

( * ) Notice: Subject to any disclaimer, the term of this patent is extended or adjusted under 35 U.S.C. 154(b) by 384 days.

(21) Appl. No.: 12/722,772

(22) Filed: Mar. 12, 2010

(65) Prior Publication Data

US 2011/0219568 A1 Sep. 15, 2011

(51) Int. Cl.
*A47L 9/00* (2006.01)

(52) U.S. Cl.
USPC ..... 15/334; 15/331

(58) Field of Classification Search
USPC ..... 15/3, 419, 246.2, 345, 346, 347, 348, 15/349, 330, 331, 353, 334, 335, 357, 328, 15/329; 251/152, 315.01, 315.07, 315.16, 251/321, 337
See application file for complete search history.

(56) References Cited

U.S. PATENT DOCUMENTS

| | | | | | |
|---|---|---|---|---|---|
| 3,348,805 | A | * | 10/1967 | Sanctuary | 251/315.05 |
| 3,561,730 | A | * | 2/1971 | Hurst | 251/315.13 |
| 4,087,986 | A | * | 5/1978 | Grahl | 62/189 |
| 4,164,343 | A | * | 8/1979 | Graebner | 251/315.07 |
| 4,287,635 | A | * | 9/1981 | Jacobs | 15/321 |
| 4,376,322 | A | * | 3/1983 | Lockhart et al. | 15/323 |
| 4,377,882 | A | | 3/1983 | Dyson | |
| 4,548,384 | A | * | 10/1985 | Harding | 251/163 |
| 4,573,236 | A | | 3/1986 | Dyson | |
| 5,078,761 | A | | 1/1992 | Dyson | |
| 5,134,750 | A | * | 8/1992 | King et al. | 15/333 |
| 5,351,361 | A | * | 10/1994 | Buchtel | 15/334 |
| 5,551,120 | A | * | 9/1996 | Cipolla et al. | 15/333 |
| 5,560,074 | A | * | 10/1996 | Graham et al. | 15/323 |
| 5,615,448 | A | * | 4/1997 | Crouser et al. | 15/321 |
| 5,715,566 | A | * | 2/1998 | Weaver et al. | 15/320 |
| 6,009,596 | A | * | 1/2000 | Buss et al. | 15/353 |
| 6,079,077 | A | * | 6/2000 | Kajihara et al. | 15/332 |
| 6,536,074 | B2 | * | 3/2003 | Boles et al. | 15/331 |
| 6,609,269 | B2 | * | 8/2003 | Kasper | 15/320 |
| 6,687,952 | B1 | * | 2/2004 | Mohan, Jr. | 15/353 |
| 6,920,665 | B2 | * | 7/2005 | Tucker | 15/334 |
| 6,936,095 | B2 | * | 8/2005 | North | 96/403 |
| 7,356,874 | B2 | * | 4/2008 | Skinner Macleod et al. | 15/328 |
| 7,367,081 | B2 | * | 5/2008 | O'Neal | 15/320 |
| 7,533,441 | B2 | * | 5/2009 | Yoo | 15/331 |

(Continued)

FOREIGN PATENT DOCUMENTS

WO 2009/026709 A1 3/2009

*Primary Examiner* — Vanitha Elgart
(74) *Attorney, Agent, or Firm* — Bereskin & Parr LLP/S.E.N.C.R.L., s.r.l.; Philip C. Mendes da Costa

(57) ABSTRACT

An upright surface cleaning apparatus is operable in a floor cleaning mode and an above floor cleaning mode. The surface cleaning apparatus includes a first upstream air flow path extending from the dirty air inlet of the floor cleaning head to a downstream air flow path, and an above floor cleaning member removably mounted to the surface cleaning apparatus. The above floor cleaning member includes an alternate dirty air inlet. The surface cleaning apparatus also includes a second upstream air flow path extending from the dirty air inlet of the above floor cleaning member to the downstream air flow path. The surface cleaning apparatus also includes a valve selectively connecting the first upstream air flow path in flow communication with the downstream air flow path when the dirty air inlet of the above floor cleaning member is placed in a storage position on the upright surface cleaning apparatus.

19 Claims, 11 Drawing Sheets

(56) References Cited

U.S. PATENT DOCUMENTS

| | | | | |
|---|---|---|---|---|
| 7,555,810 | B2 * | 7/2009 | Pullins et al. | 15/331 |
| 7,559,112 | B2 * | 7/2009 | Lee et al. | 15/331 |
| 7,676,883 | B2 * | 3/2010 | Macleod et al. | 15/334 |
| 7,805,807 | B2 * | 10/2010 | Blocker et al. | 15/422.2 |
| 8,032,982 | B2 * | 10/2011 | Lee et al. | 15/335 |
| 8,091,174 | B2 * | 1/2012 | Coburn et al. | 15/331 |
| 2004/0060144 | A1 * | 4/2004 | Bowden et al. | 15/334 |
| 2005/0071945 | A1 * | 4/2005 | Lee | 15/334 |
| 2005/0127317 | A1 * | 6/2005 | Rebello | 251/209 |
| 2007/0209142 | A1 * | 9/2007 | Pullins et al. | 15/334 |
| 2008/0157018 | A1 * | 7/2008 | Kessell et al. | 251/315.01 |
| 2008/0178420 | A1 * | 7/2008 | Conrad | 15/410 |
| 2008/0196366 | A1 * | 8/2008 | Conrad | 55/337 |
| 2008/0209666 | A1 * | 9/2008 | Conrad | 15/329 |
| 2010/0088842 | A1 * | 4/2010 | Worker et al. | 15/353 |

* cited by examiner

VALVE FOR A SURFACE CLEANING APPARATUS

FIELD

The disclosure relates to surface cleaning apparatuses, such as vacuum cleaners and preferably to an upright vacuum cleaner. Particularly, the disclosure relates to surface cleaning apparatus having a dirty air inlet fluidly connected to a suction motor and an air treatment unit by an air flow path and an air flow redirecting valve provided in the air flow path.

INTRODUCTION

The following is not an admission that anything discussed below is prior art or part of the common general knowledge of persons skilled in the art.

Various constructions for surface cleaning apparatus such as vacuum cleaners are known. Currently, many surface cleaning apparatus are constructed using at least one cyclonic cleaning stage. The air is drawn into the vacuum cleaner through a dirty air inlet and conveyed to a cyclone inlet. The rotation of the air in the cyclone results in some of the particulate matter in the airflow stream being disentrained from the airflow stream. This material is then collected in a dirt collection chamber, which may be at the bottom of the cyclone or in a dirt collection chamber exterior to the cyclone chamber (see for example WO2009/026709 and U.S. Pat. No. 5,078,761). One or more additional cyclonic cleaning stages and/or filters may be positioned downstream from the cyclone.

SUMMARY

The following summary is provided to introduce the reader to the more detailed discussion to follow. The summary is not intended to limit or define the claims.

According to one aspect, a surface cleaning apparatus is operable in a first cleaning mode and in a second above floor cleaning mode, such as by using an extension hose and wand. When used in a first mode, the air flow extends from a dirty air inlet, such as the dirty air inlet of a floor cleaning head of an upright vacuum cleaner, to an air treatment member (e.g., a cyclone). In a second mode, an alternate air flow path is provided. The air flow paths may join upstream of the cyclone. A valve is provided to enable air to be drawn from a selected dirty air inlet based on the cleaning mode that is desired. In accordance with this aspect, the valve is utilized to open and close only one of the paths upstream of the air treatment member and preferably the path from a floor cleaning head. Accordingly, the path from the dirty air inlet of the above floor cleaning member to the air treatment member remains open. However, if the dirty air inlet of the above floor cleaning member is sealed, such as being mounted in a storage position on the surface cleaning apparatus or the dirty air inlet of the above floor cleaning member or any port of the air flow path of the above floor cleaning member is otherwise closed, such as by a valve or closure flap, then no net flow will occur through the above floor cleaning member.

One advantage of this design is that the valve may be positioned in a straight portion of an air flow conduit, e.g., an up flow duct. The valve may be configured so as not to reduce the cross section of the air flow path. For example, if the valve is a ball valve, the diameter of the air flow path through the ball valve may be the same as that of the conduit Therefore, the passage of an air stream through the valve with not restrict flow. This will enhance the cleanability of the unit as the air flow at the dirty air inlet of the floor cleaning head will not be reduced. Further, maintaining about the same diameter for air flow will reduce the likelihood of a clog occurring in or at the valve.

A further advantage is the valve does not create a further change is the direction of air flow. A change in air flow direction, such as a 90° degree bend, will create back pressure and reduce air flow. By controlling the flow through only one of two alternate air flow passages, the valve need not create a redirection of air flow.

Preferably, the ball valve is sized so as to permit a small flow of air around the outer perimeter of the ball valve when the valve is in the closed position. This will assist in preventing dirt building up on the outer surface and impairing the mobility of the valve. Further, it will provide a source of bleed air to the air treatment member if the above floor cleaning member is used in a sealed suction condition.

According to this aspect, an upright surface cleaning apparatus is operable in a floor cleaning mode and an above floor cleaning mode. The upright surface cleaning apparatus comprises a floor cleaning head having a dirty air inlet and an upper section comprising a handle drivingly connected to the floor cleaning head. The surface cleaning apparatus also includes a first upstream air flow path extending from the dirty air inlet of the floor cleaning head to a downstream air flow path, and an above floor cleaning member removably mounted to the surface cleaning apparatus. The above floor cleaning member includes an alternate dirty air inlet. The surface cleaning apparatus also includes a second upstream air flow path extending from the dirty air inlet of the above floor cleaning member to the downstream air flow path. The downstream air flow path includes an air treatment member and a suction motor and extends from each upstream air flow path to a clean air outlet. The surface cleaning apparatus also includes a valve selectively connecting the first upstream air flow path in flow communication with the downstream air flow path when the dirty air inlet of the above floor cleaning member is placed in a storage position on the upright surface cleaning apparatus.

In some examples, the valve is operable only to selectively connecting the first upstream air flow path in flow communication with the downstream air flow path.

In some examples, the second upstream air flow path includes a hose. The valve is operable between an open position in which the first upstream air flow path is in flow communication with the downstream air flow path and a closed position in which the first upstream air flow path is isolated from flow communication with the downstream air flow path. The hose has an outlet end that remains in flow communication with the downstream air flow path regardless of the position of the valve.

In some examples, the valve is external to the second upstream air flow path and the downstream air flow path.

In some examples, the dirty air inlet of the above floor cleaning member is sealed when the above floor cleaning member is in the storage position.

In some examples, the second upstream air flow path includes a hose. The valve is operable between an open position in which the first upstream air flow path is in flow communication with the downstream air flow path and a closed position in which the first upstream air flow path is isolated from flow communication with the downstream air flow path. The hose has an outlet end and the alternate dirty air inlet and the outlet end of the hose remains in flow communication with the downstream air flow path regardless of the position of the valve.

In some examples, the valve comprises a ball valve.

In some examples, the valve automatically closes the first air flow path when the above floor cleaning member is removed from its storage position.

In some examples, the valve comprises a ball valve and the valve is selectively rotatable to isolate the air treatment member from the first upstream air flow path when the above floor cleaning member is removed from its storage position.

In some examples, the valve is operable between an open position in which the first upstream air flow path is in flow communication with the downstream air flow path and a closed position in which the first upstream air flow path is isolated from flow communication with the downstream air flow path and the valve is biased to the closed position.

In some examples, the surface cleaning apparatus also includes a valve drive member. The valve comprises a rotatable member and the valve drive member includes a lever eccentrically mounted to the valve and drivenly operated upon positioning the above floor cleaning member in the storage position.

In accordance with another aspect, an upright surface cleaning apparatus is operable in a floor cleaning mode and an above floor cleaning mode. The upright surface cleaning apparatus comprises a floor cleaning head having a dirty air inlet and an upper section comprising a handle drivingly connected to the floor cleaning head. The surface cleaning apparatus also includes a first upstream air flow path extending from the dirty air inlet of the floor cleaning head to a downstream air flow path and an above floor cleaning member removably mounted to the surface cleaning apparatus that has an alternate dirty air inlet. The surface cleaning apparatus also includes a second upstream air flow path extending from the dirty air inlet of the above floor cleaning member to the downstream air flow path. The downstream air flow path including an air treatment member and a suction motor and extending from each upstream air flow path to a clean air outlet. The surface cleaning apparatus also includes a valve external to the second upstream air flow path and the downstream air flow path. The valve is operable to selectively connect the first upstream air flow path in flow communication with the downstream air flow path.

In some examples, the valve selectively connects the first upstream air flow path in flow communication with the downstream air flow path when the dirty air inlet of the above floor cleaning member is placed in a storage position on the upright surface cleaning apparatus.

In some examples, the second upstream air flow path includes a hose. The valve is operable between an open position in which the first upstream air flow path is in flow communication with the downstream air flow path and a closed position in which the first upstream air flow path is isolated from flow communication with the downstream air flow path. The hose has an outlet end that remains in flow communication with the downstream air flow path regardless of the position of the valve.

In some examples, the dirty air inlet of the above floor cleaning member is sealed when the above floor cleaning member is in a storage position.

In some examples, the second upstream air flow path includes a hose. The valve is operable between an open position in which the first upstream air flow path is in flow communication with the downstream air flow path and a closed position in which the first upstream air flow path is isolated from flow communication with the downstream air flow path. The hose has an outlet end and the alternate dirty air inlet and the outlet end of the hose remain in flow communication with the downstream air flow path regardless of the position of the valve In some examples, the valve comprises a ball valve.

In some examples, the valve automatically closes the first air flow path when the above floor cleaning member is removed from a storage position.

In some examples, the valve comprises a ball valve and the valve is selectively rotatable to isolate the air treatment member from the first upstream air flow path when the above floor cleaning member is removed from a storage position.

In some examples, the valve is operable between an open position in which the first upstream air flow path is in flow communication with the downstream air flow path and a closed position in which the first upstream air flow path is isolated from flow communication with the downstream air flow path and the valve is biased to the closed position.

In some examples the surface cleaning apparatus also includes a valve drive member and the valve comprises a rotatable member. The valve drive member includes a lever eccentrically mounted to the valve and drivenly operated upon positioning the above floor cleaning member in a storage position.

DRAWINGS

Reference is made in the detailed description to the accompanying drawings, in which.

DETAILED DESCRIPTION

Figure 1:
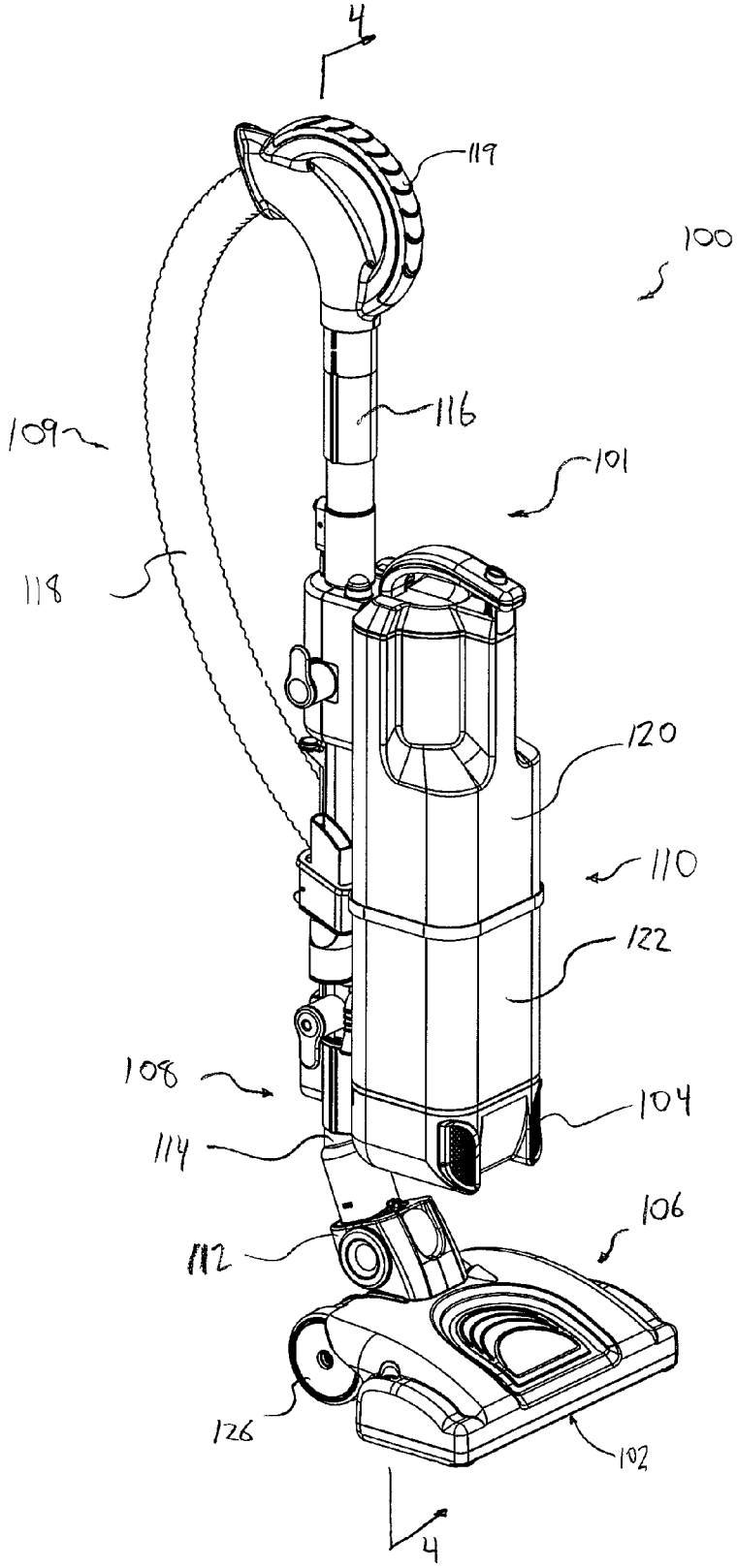
FIG. 1 is a front isometric view of a surface cleaning apparatus.
Figure 2:
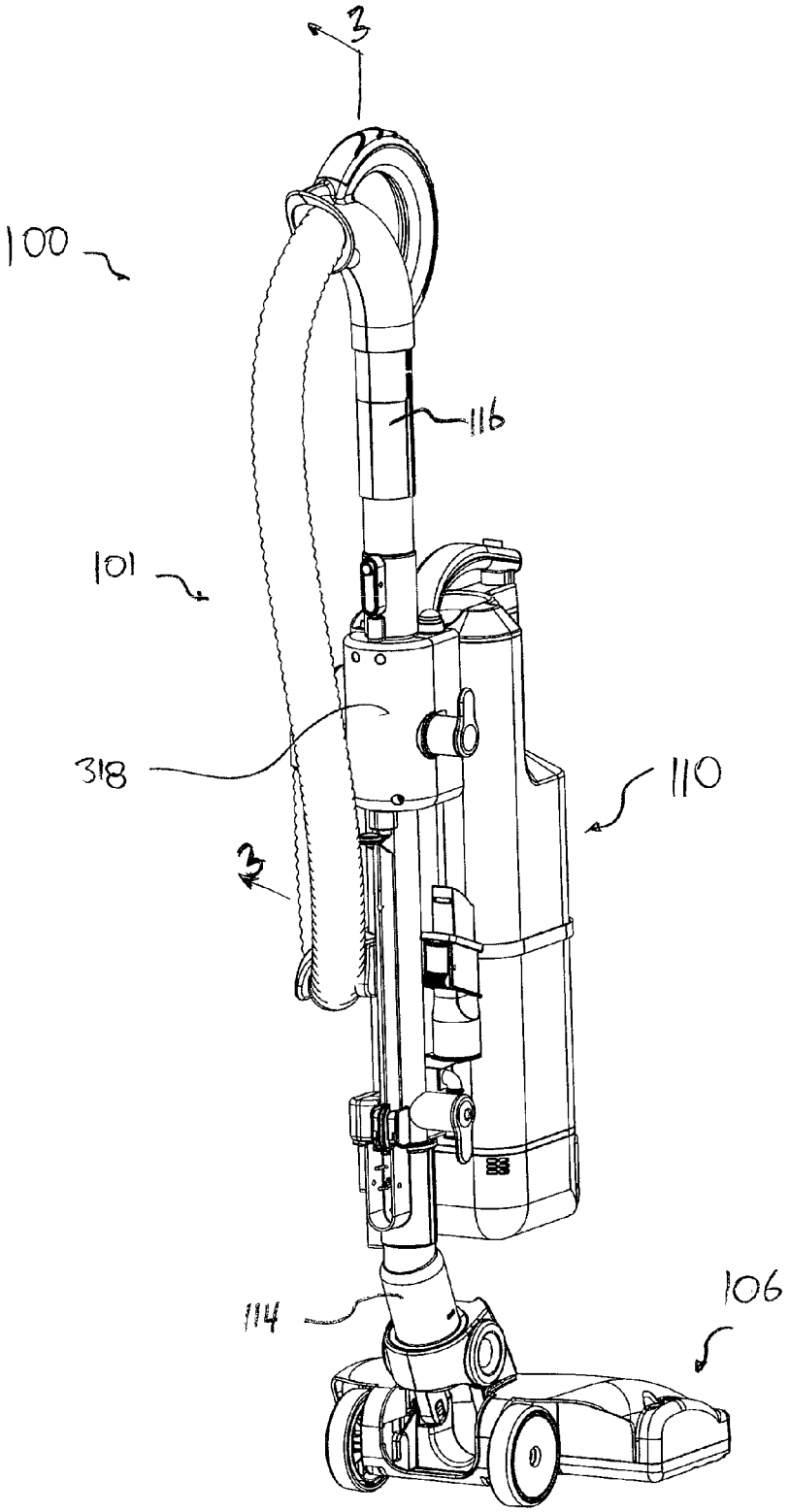
FIG. 2 is a rear isometric view of the surface cleaning apparatus of FIG. 1.

Referring to FIGS. 1 and 2, a surface cleaning apparatus 100 is shown. In the embodiment shown, the surface cleaning apparatus 100 is an upright vacuum cleaner. In alternate embodiments, the surface cleaning apparatus may be another suitable type of surface cleaning apparatus, such as a canister type vacuum cleaner, and hand vacuum cleaner, a stick vac, a wet-dry type vacuum cleaner or a carpet extractor. In the present example the upright surface cleaning apparatus 100 is operable in at least first and second operating modes. In some examples, the first operating mode is a floor cleaning mode and the second operating mode is an above floor cleaning mode. The surface cleaning apparatus 100 can also be configured in a storage position, as exemplified in FIG. 1.

The upright surface cleaning apparatus 100 includes a floor cleaning head, for example surface cleaning head 106 and an upper section, for example upper section 101 that is pivotally connected to, and supported by, the surface cleaning head 106. The upper section 101 can be connected to the surface cleaning head 106 using any suitable pivotal or moveable (for example pivotal and rotatable) connection known in the art. The surface cleaning head includes a dirty air inlet 102 for cleaning a surface, for example a floor. The surface cleaning head 106 is rolling supported above the surface to be cleaned using rear wheels 126.

The upper section 101 includes a lower upflow duct 114, an upper upflow duct 116 and a cleaning unit 110, for example a suction and filtration unit. The upper section also includes a grip or handle 119 that is drivingly connected to the floor cleaning head 106 by the substantially rigid lower and upper upflow ducts 114, 116. The handle 119 allows a user to manipulate the surface cleaning apparatus 100 and maneuver the surface cleaning head 106 across the floor.

The cleaning unit 110 includes a filtration member housing 120, and a suction motor housing 122. The filtration member housing 122 houses filtration or air treatment member, for example a cyclone, which is positioned in the airflow passage downstream of the dirty air inlet 102 for removing particulate matter from air flowing through the cleaning unit. The suction motor housing 122 houses a suction motor (not shown), which is provided in the airflow passage downstream of the cyclone for drawing air through the airflow passage. The cleaning unit 110 is mounted on the upper section 101 and has a cleaning unit inlet 111 that is selectably connectable to a pair of dirty air inlets, as exemplified in FIGS. 4 and 8-11 and explained in greater detail below.

In the embodiment shown, as the suction motor housing 122 is mounted to the lower upflow duct 114, and the filtration member housing 120 is removably mounted to the suction motor housing 122 above the suction motor housing 122, the filtration member housing 120 may optionally be secured to the suction motor housing 122 using one or more latches or locking members (not shown). In such instances the filtration member housing 120 can be detached from the suction motor housing by unlatching the one or more latch members, and lifting the filtration member housing 120 off of the suction motor housing 122. When this is done, the filtration member housing 120 will be generally sealed, except for any airflow passages leading to or from the filtration member housing 120, and the top of the suction motor housing 122 will be open. The top of the suction motor housing 122 may be covered with a suitable pre-motor filter positioned upstream of the suction motor and downstream of the cyclone. The suction motor housing 122 may also include a post-motor filter downstream of the suction motor and upstream of the clean air outlet. The post-motor filter may be any suitable type of filter, such as, for example, a HEPA filter.

Optionally, the cleaning unit 110 can be releasably mounted to the supporting structure of the surface cleaning apparatus 100. The releasable connection between the suction and filtration unit 110 and the supporting structure can be of any suitable type, and can optionally including locking means for securing the cleaning unit 110 in place.

Referring still to FIG. 1, the surface cleaning apparatus 100 also has a clean air outlet 104 and an air flow path extending between the clean air outlet 104 and at least one dirty air inlet. The portion of the air flow path that includes the cleaning unit 110 and the clean air outlet 104 can be referred to as a downstream air flow path. One example of a downstream air flow path is the air flow path that extends from an cleaning unit air inlet 111 to the clean air outlet 104. The surface cleaning apparatus 100 is configurable so that the downstream air flow path, i.e. the cleaning unit inlet 111, can be communicably linked to dirty air inlets used to suck in dirt and debris, so that vacuum suction created by the cleaning unit 110 can reach each dirty air inlet.

Figure 3:
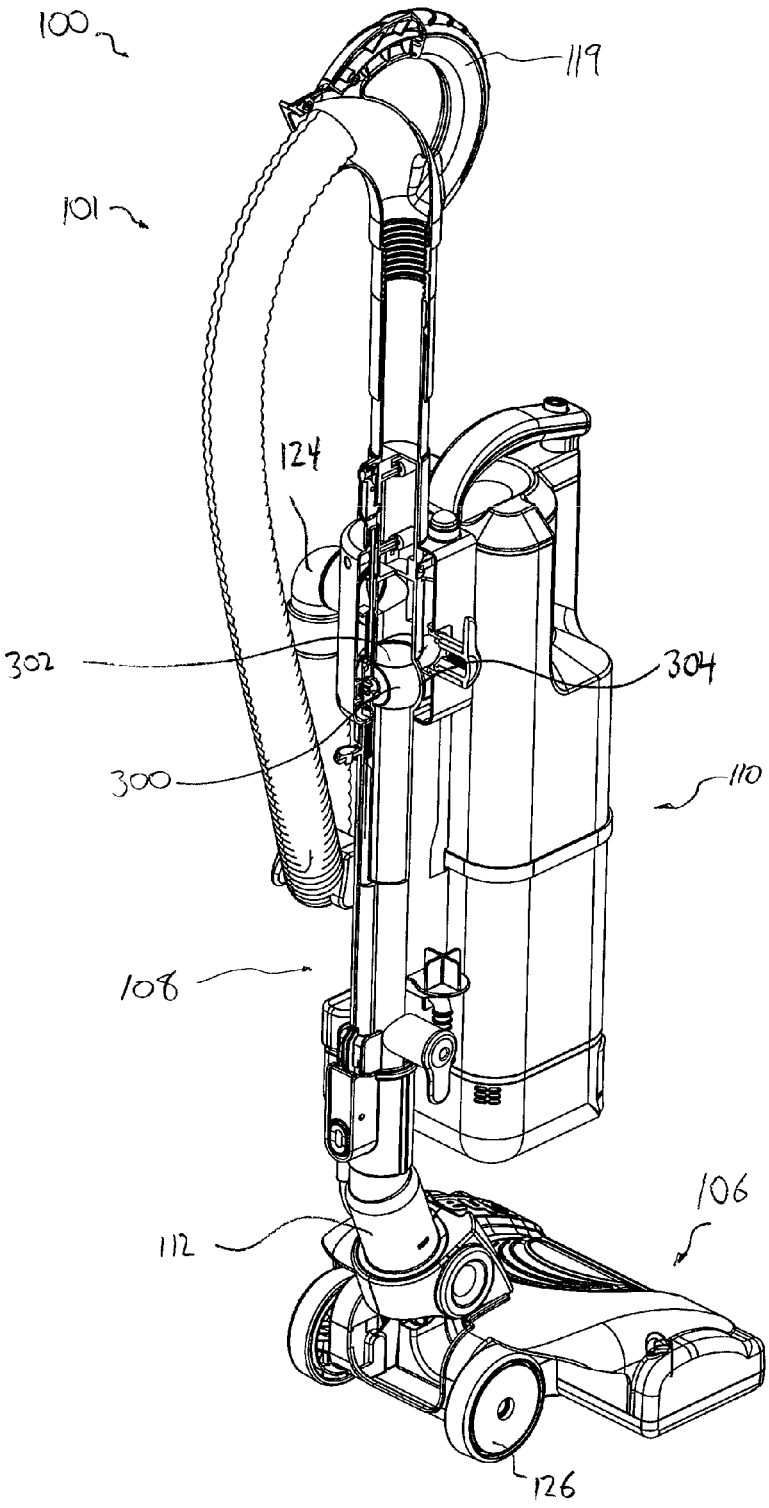
FIG. 3 is a partial section view taken along line 3-3 in FIG. 2.
Figure 4:
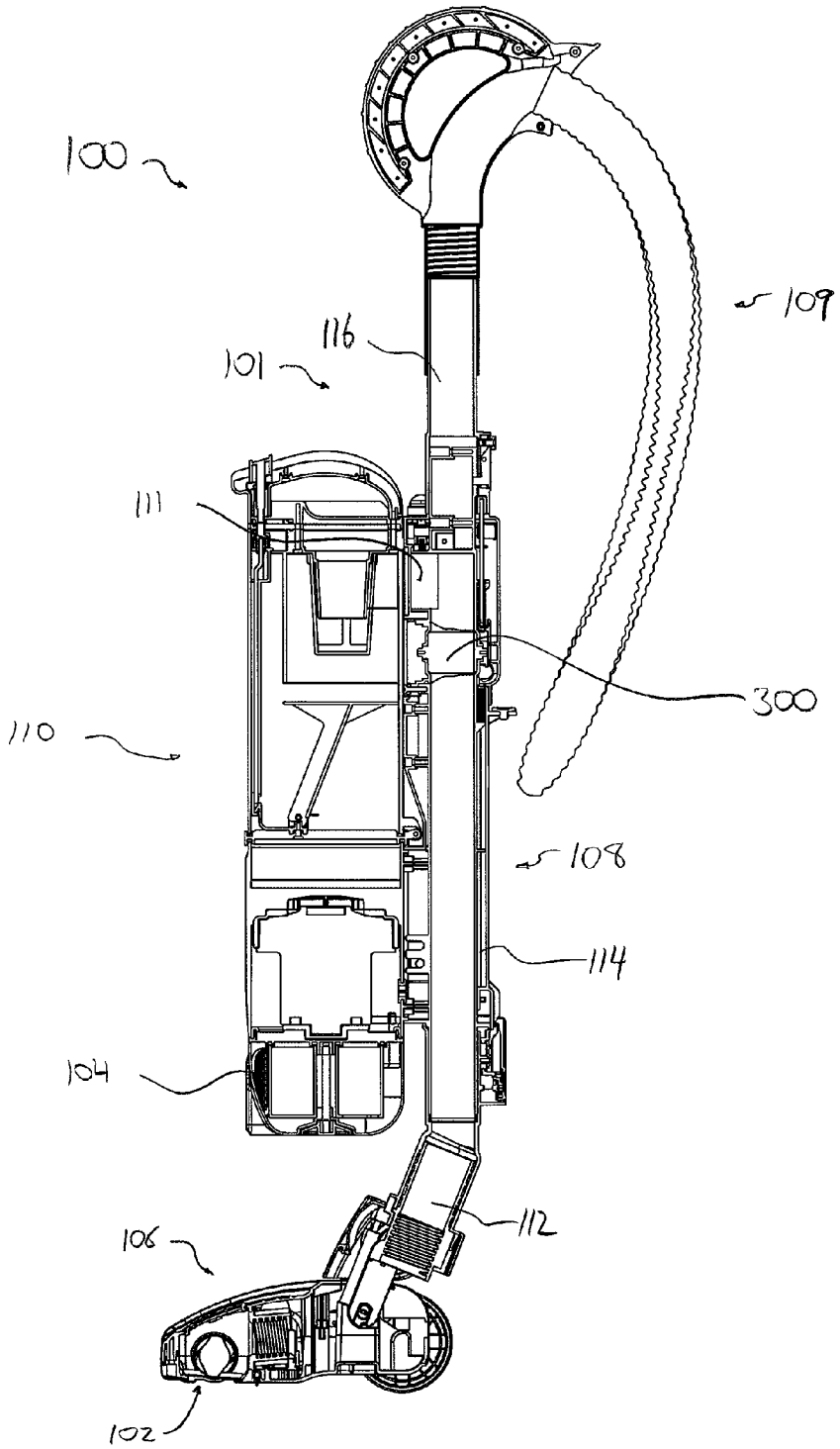
FIG. 4 is section view taken along line 4-4 in FIG. 1.
Figure 5:
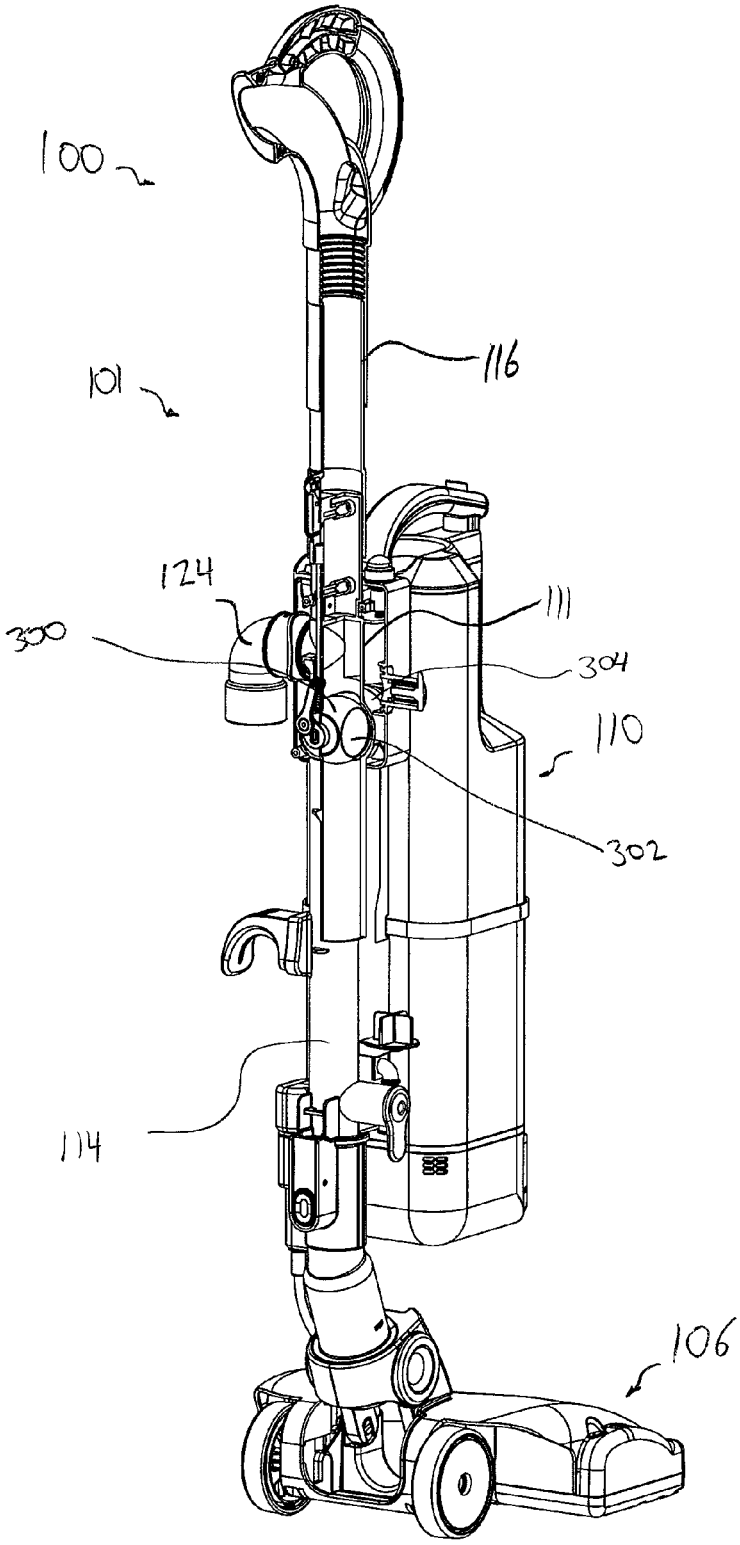
FIG. 5 is the section view of FIG. 3 with the valve in a closed position.

One example of such a dirty air inlet is the dirty air inlet 102 provided in the surface cleaning head 106. Dirty air inlet 102 is active (i.e. communicably linked to cleaning unit inlet 111 and exposed to vacuum suction from the cleaning unit 110) when the surface cleaning apparatus 100 is operated in a floor cleaning mode, as exemplified in FIGS. 1-3.

Another example of such a dirty air inlet is a second or alternate dirty air inlet 103 defined by an open end of an above floor cleaning member, for example the open, upstream end of upper upflow duct 116. The dirty air inlet 103 is active when the surface cleaning apparatus 100 is operated in an above floor cleaning mode, as exemplified in FIGS. 6 and 7. In the above floor cleaning mode a user can release the upper upflow duct 116 from the upper section 101, exposing dirty air inlet 103 which can be used to clean elevated surfaces, furniture, drapes and other areas that are difficult to clean using the surface cleaning head 106. Each dirty air inlet 102, 103 can be fluidly connected to the cleaning unit 110 by respective upstream air flow paths.

A first or floor cleaning upstream air flow path 108 extends from the dirty air inlet 102, through the surface cleaning head 106 and a portion of the upper section 101 until it joins the downstream air flow path, for example at cleaning unit inlet 111. As exemplified in FIGS. 2 and 3, the floor cleaning upstream air flow path 108 can include a portions of the lower upflow duct 114, conduit portions of the pivot mount 112 connecting the upper section 101 to the surface cleaning head 106 and one or more suitable air flow conduits connecting the dirty air inlet 102 to the pivot mount 112. Generally, air flow path 108 at least fluidly connects the dirty air inlet 102 to the cleaning unit inlet 111.

A second or above floor cleaning air flow path 109 extends from the dirty air inlet 103 to the downstream air flow path, which begins at cleaning unit inlet 111. The second air flow path 109 includes upper upflow duct 116 and a flexible conduit member, for example flexible hose 118, that allows a user to freely manipulate the upper upflow duct 116 when it is being used as an above floor cleaning tool. In some examples the upper upflow duct 116 can function as a cleaning wand and can also be configured to be connected to a plurality of additional or auxiliary cleaning tools, including, for example, extension wands, brushes, nozzles and crevasse tools. The upstream end of the hose 118 is connected to the upper upflow duct 116 in any suitable manner, including a fixed coupling or a rotatable coupling and optionally a detachable coupling. The downstream end of the hose 118 is connected to the upper section 101 using any suitable coupling member, including, for example, elbow 124 (as exemplified in FIGS. 3 and 5-8), which can be rotatably, and optionally detachably, coupled to both the hose 118 and the upper section 101.

In the present example, air flow between the dirty air inlet 102 and the cleaning unit inlet 111, i.e. air flow through the floor cleaning upstream air flow path 108, can be selectively controlled or regulated using an air flow regulator, which can be any suitable type of regulator including, for example, a ball valve 300. The ball valve 300 is positioned in the floor cleaning upstream air flow path 108, between the dirty air inlet 102 and the cleaning unit inlet 111. The ball valve 300 is rotatable between an open position to enable air to flow between the dirty air inlet 102 and the cleaning unit inlet 111, as exemplified in FIGS. 3, 4 and 10, and a closed position blocking the air flow path 108 and inhibiting the air flow between the dirty air inlet 102 and the cleaning unit inlet 111, as exemplified in FIGS. 5, 7 and 9.

The ball valve 300 includes a central bore 302 and is pivotally or rotatably mounted within a valve housing 304. In this example, the valve housing 304 is integral with a conduit portion (lower upflow duct 114) of the upper section 101. In other examples, the valve housing may be a separate member mounted to the upper section. When the ball valve 300 is rotated to the open position, the central bore 302 is aligned with the air flow path 108, for example the interior of lower upflow duct 114, thereby completing the air flow path between dirty air inlet 102 and cleaning unit inlet 111.

Optionally the central bore 302 may have a smaller diameter that the lower flow duct 114. Providing a smaller central bore 302 can restrict the air flow in the lower upflow duct 114 and may also increase the likelihood of debris entrained in the air flow becoming stuck in the central bore 302, clogging the air flow path 108. Alternatively, the central bore 302 may have a larger diameter than the lower upflow duct 114. In such examples the likelihood of clogging or jamming may be reduced, but the sudden change in air flow path diameter may cause pressure fluctuations, eddy currents and other potentially undesirable air flow conditions. However, based on user needs and specifications, a functional surface cleaning apparatus 100 can include a ball valve 300 of either configuration.

Preferably, as exemplified in the present embodiment, the size, or internal diameter of the central bore 302 is generally equal to the internal diameter of the lower upflow duct 114. In this configuration, when the ball valve 300 is in the open position, the central bore 302 and the interior surface of the lower upflow duct 114 cooperate to form a generally smooth, continuous air flow conduit having a generally constant diameter or width. Sizing the central bore 302 to match the diameter of the lower upflow duct 114 can enable a consistent, uniform air flow through the air flow path 108.

The outer diameter or width of the ball valve 300 is selected so that the ball valve 300 can be freely and rotatable received within the valve housing 304. In the present embodiment, the width of the ball valve 300 is slightly smaller than the inner diameter of the valve housing 304. In this configuration a gap or flow channel is defined between the outer surface of the ball valve 300 and the inner surface of the valve housing 304. The thickness of the gap can be determined based on the relative sizes of the ball valve 300 and the housing 304. The thickness of the gap, i.e. the clearance between the valve 300 and the housing 304, can be between 0.1-1.0 millimeters, and optionally between 0.25 and 0.5 millimeters.

Providing a gap between the valve 300 and the housing 304 can enable a relative small amount of air, for example a bleed air flow, to flow through the gap when the valve 300 is in the closed position. Enabling a bleed flow of air to pass between the valve 300 and the housing 304 can serve to clean the outer surface of the valve 300 of accumulated dirt and debris and may help prevent burnout of the suction motor. In other examples, the valve 300 may be snugly received within the housing 304 creating an air-tight seal when the valve 300 is closed.

Figure 6:
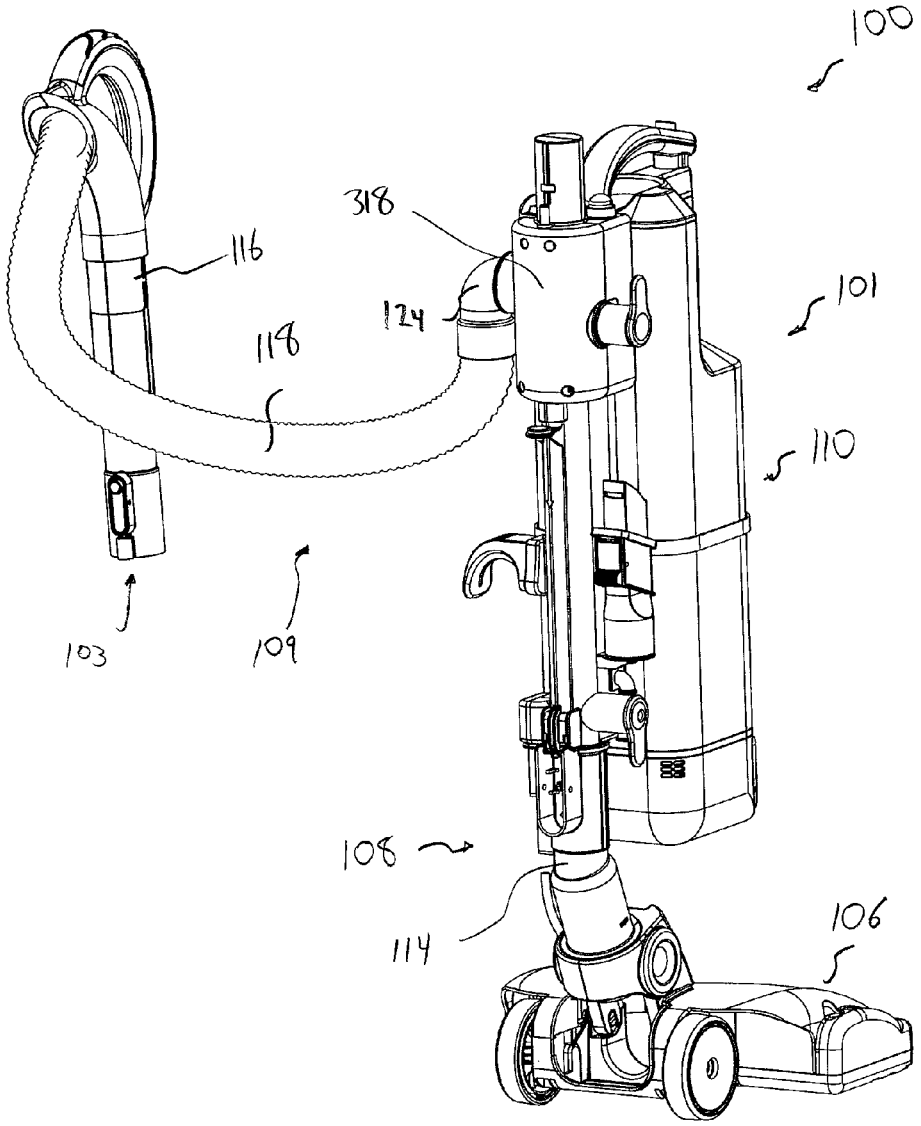
FIG. 6 is a rear isometric view of the surface cleaning apparatus of FIG. 1 in an above floor cleaning mode.
Figure 7:
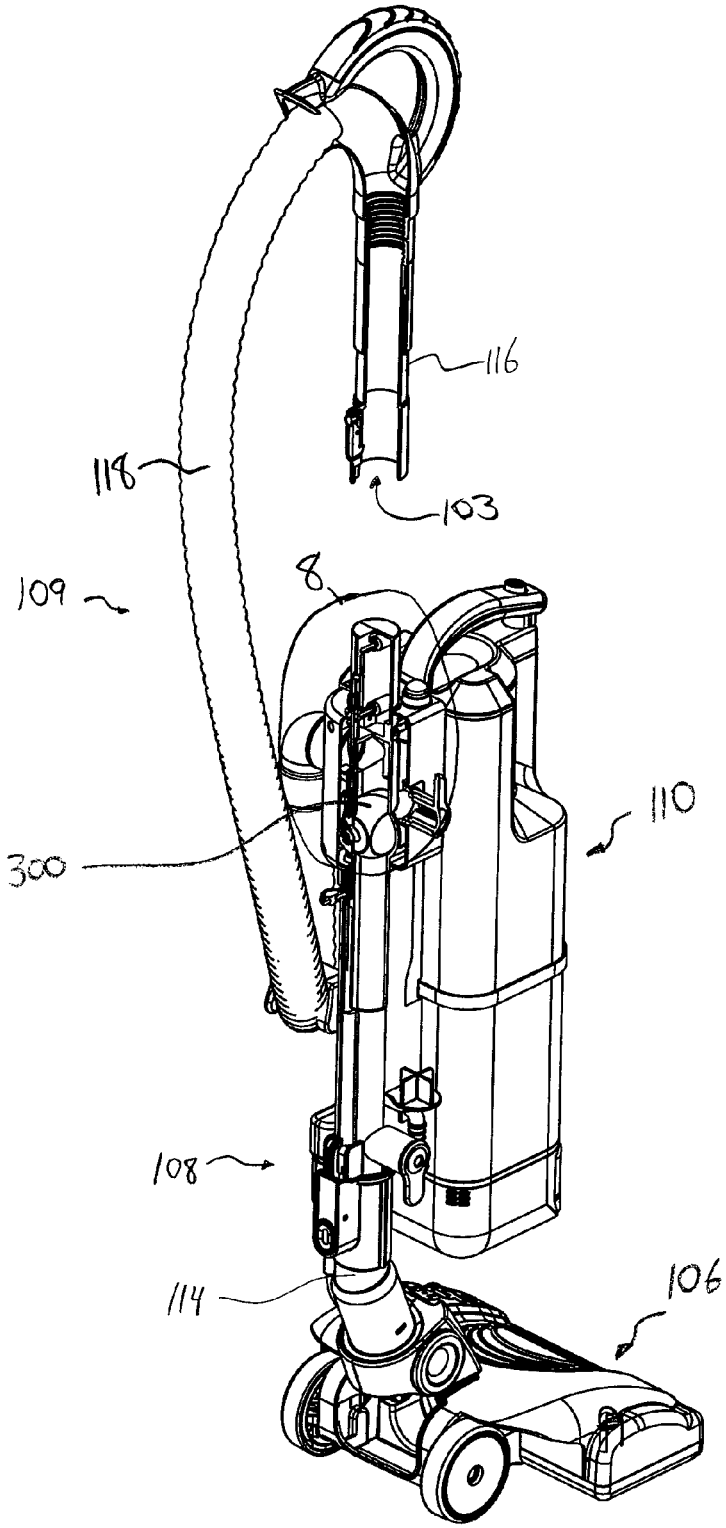
FIG. 7 is a partial section view of the surface cleaning apparatus of FIG. 6.
Figure 8:
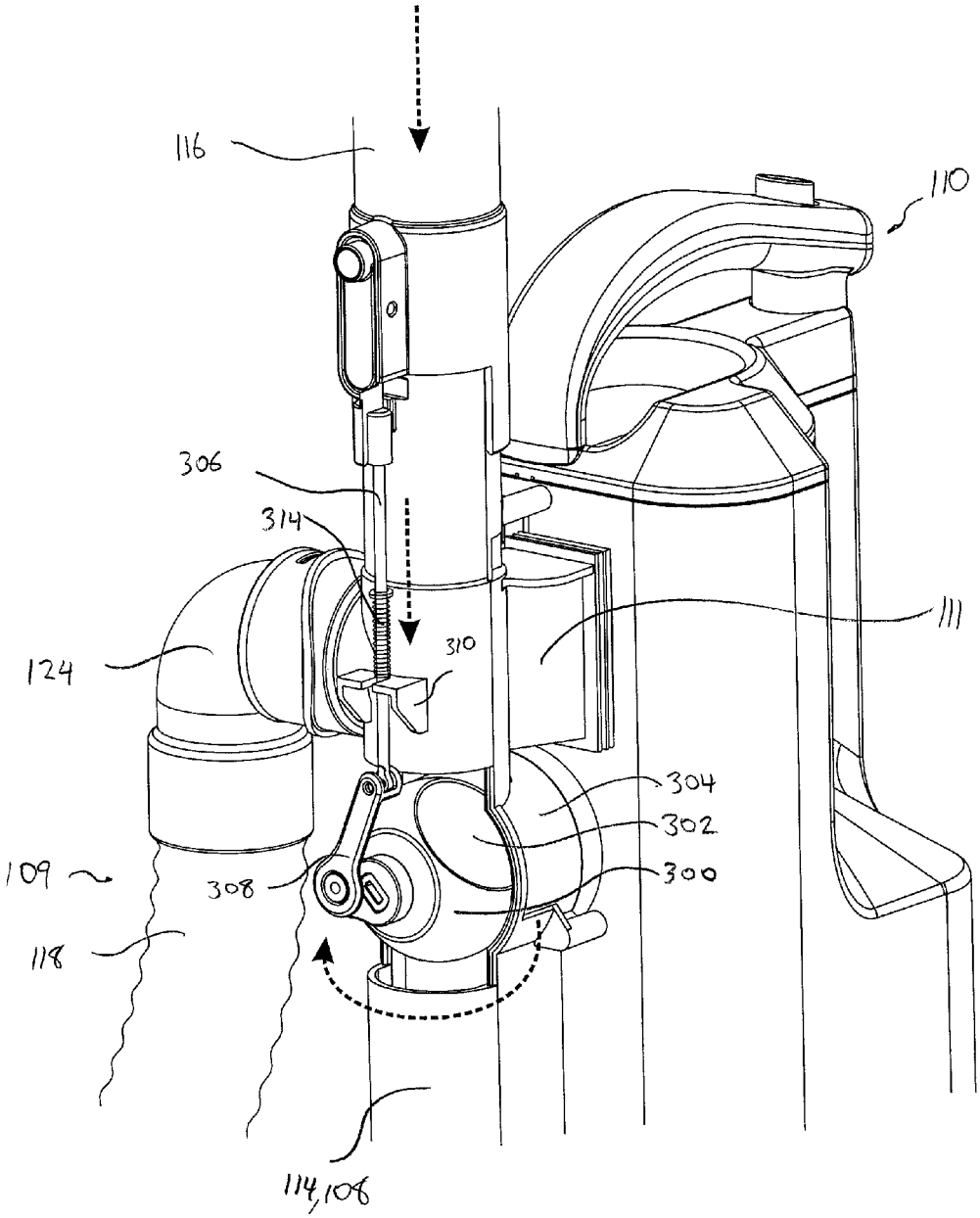
FIG. 8 is an enlarged view of the portion contained within circle 8 in FIG. 7, with the valve in an intermediate position.

As exemplified, the ball valve 300 is only configured to regulate the air flow in the floor cleaning upstream air flow path 108, and is not operable to control the air flow in air flow path 109. Accordingly, in the present embodiment, the above floor cleaning upstream air flow path 109 is continuously in fluid communication with the cleaning unit inlet 111, in both the floor cleaning configuration (FIG. 1) and the above floor cleaning configuration (FIG. 6). That is, an outlet or downstream end of the flexible hose 118 remains in flow communication with the cleaning unit inlet 111 (i.e. the downstream air flow path) regardless of the position of the valve 300. Even though the air flow path 109 remains in communication with the cleaning unit inlet 111, in instances when the dirty air inlet 103 is sealed, for example when the upper upflow duct 116 is connected to the upper section 101 in a storage position, there will be virtually no net airflow through the air flow path 109.

Providing a valve in only one of the air flow paths 108, 109 allows the valve to be mechanically simpler and lighter than a valve that is operably in communication with both flow paths 108, 109. A lighter valve member may be advantageous as it may reduce the total weight of the surface cleaning apparatus 100, which may reduce user fatigue. A single path valve, like valve 300, may also be less prone to mechanical failure and may be less costly to manufacture and install. However, in some examples, a valve may be communicably linked to both air flow paths 108, 109 and may be operable to selectably connect one of, or both of, the air flow paths 108, 109 to the cleaning unit inlet 111.

In the present embodiment, the valve 300 does not create a further change is the direction of the air flowing in air flow path 108. A change in air flow direction, such as a 90° degree bend or other diversion, can create back pressure and reduce air flow. By controlling the flow through only one of two alternate air flow passages, the valve 300 need not create a redirection of air flow.

The surface cleaning apparatus 100 also includes a valve control or valve drive apparatus, that is drivingly connected to the valve, for rotating the valve 300 between the open and closed positions. As exemplified in FIGS. 8-11, the valve control apparatus includes a linkage rod 306 that is rotatably connected to a lever 308, which is eccentrically and non-rotatably mounted to the valve 300. The linkage rod 306 is slidably or translatably connected to the upper section 101 using a bracket 310 and rail 312, that enable the linkage rod 306 to slide vertically while preventing relative rotation or angular movement. Movement of the linkage rod 306 results in eccentric loading on the valve 300, due to the eccentric mounting of lever 308, causing rotation of the valve 300. In other examples, the linkage rod 306 can be drivingly connected to valve 300 using any suitable connecting member, including, for example gears, rack an pinion and pulleys. Optionally, movement of the valve 300 can be facilitated or assisted by a powered drive unit, such as an electric motor.

The valve control apparatus also includes a biasing element, for example spring 314, that acts on the linkage rod 306 biasing the linkage rod 306 upward, thereby urging the valve 300 toward the closed position. Opposing ends of the spring 314 are attached to the bracket 310 and linkage rod 306 respectively. In this configuration, in the absence of a downward force exerted on the linkage rod 306, the valve will 300 will automatically return to the closed position. Because the valve 300 only controls air flow in air flow path 108, air flow path 109 (the above floor cleaning upstream air flow path) is in constant communication with the cleaning unit 110. In contrast, air flow path 108 is in communication with the cleaning unit 110 when the valve 300 is open, but not when the valve is closed 110.

Optionally, as exemplified in FIGS. 2 and 6, the valve 300, valve housing 304 and at least a portion of the valve control apparatus can be enclosed by an outer cover or shell 318, to protect and visually obscure the components. The shell 318 can be removably attached to the upper section 101 to allow access to the valve 300 and valve control apparatus for inspection and maintenance. In other examples, the upper section 101 may not include a shell 318, and the valve 300 and valve control apparatus may be exposed.

As described herein, the surface cleaning apparatus 100 is operable in a floor cleaning mode, in which the surface cleaning head 106 is moved across a floor to be cleaned and dirt is sucked in through dirty air inlet 102, and an above floor cleaning mode, in which the upper upflow conduit 116 is detached from the upper section 101 and used as a cleaning wand and in which dirt and debris are sucked in through alternate dirty air inlet 103. Dirty air, represented by arrows 299 in FIG. 10, can then flow along air flow path 108, from dirty air inlet 102 to cleaning unit inlet 111.

When the surface cleaning apparatus 100 is configured in the floor cleaning mode, the ball valve 300 is operable to selectively connect the first upstream air flow path 108 in fluid communication with the downstream air flow path, via cleaning unit inlet 111, so that vacuum suction can be applied to the dirty air inlet 102. In this configuration, dirt and debris enters dirty air inlet 102, advances along air flow path 108, through valve 300 and are received in the cleaning unit 110 for treatment. In some instances, the dirt and debris collected using the surface cleaning head 106 tends to be small enough that it is unlikely to block or foul valve 300.

In the present example, the valve control apparatus is configured so that when a user places the upper upflow duct 116 onto a mount 316, for example a section of conduit on the upper section 101, the upstream end of the upper upflow duct 116 engages the linkage rod 306. As the upper upflow duct 116 is advanced on the mount 316 (as represented by dashed arrows in FIG. 8), the force exerted on the linkage rod 306 by the upper upflow duct 114 can overcome the upward biasing force exerted by the spring 314, and the linkage rod 306 is driven downward, thereby rotating the valve 300 into the open position.

Because the valve 300 is not operable to control the air flow in air flow path 109, air flow path 109 remains in communication with the cleaning unit 110 when the surface cleaning apparatus 100 is in floor cleaning mode. In this configuration, allowing outside air to be drawn into air flow path 109 could reduce the vacuum suction acting on dirty air inlet 102 and may reduce the cleaning efficiency of the surface cleaning apparatus 100. To inhibit leakage and/or to preserve vacuum suction within air flow path 108, the connection between mount 316 and the upstream end of the upper upflow duct 116 (that comprises dirty air inlet 103) is a substantially air-tight seal. The air-tight connection can be any known air-tight sealing device. Optionally, a sealing or gasketing member can be positioned between mount 314 and upper upflow duct 116.

Figure 9:
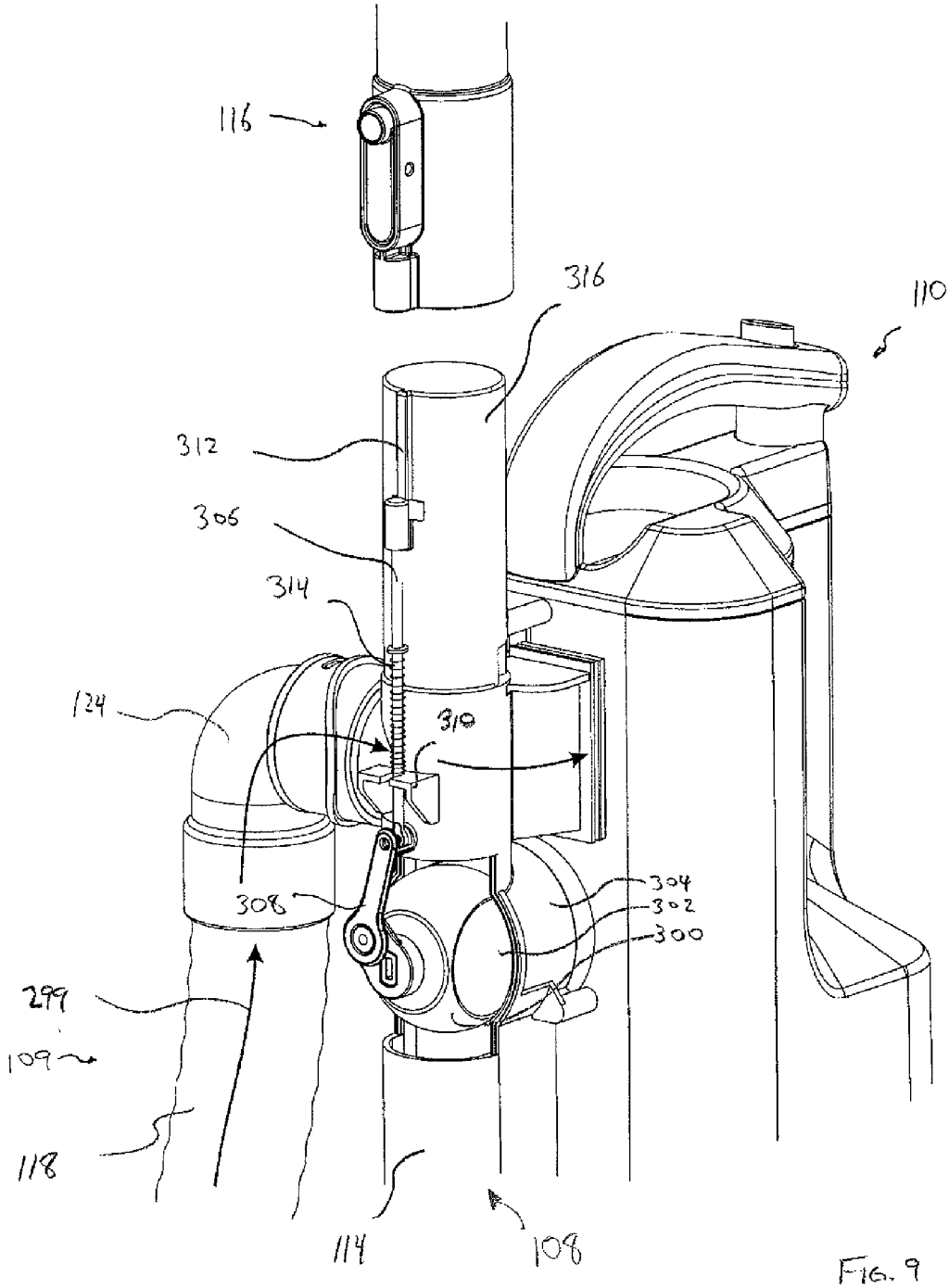
FIG. 9 is the enlarged view of FIG. 8 with the valve in closed position.
Figure 10:
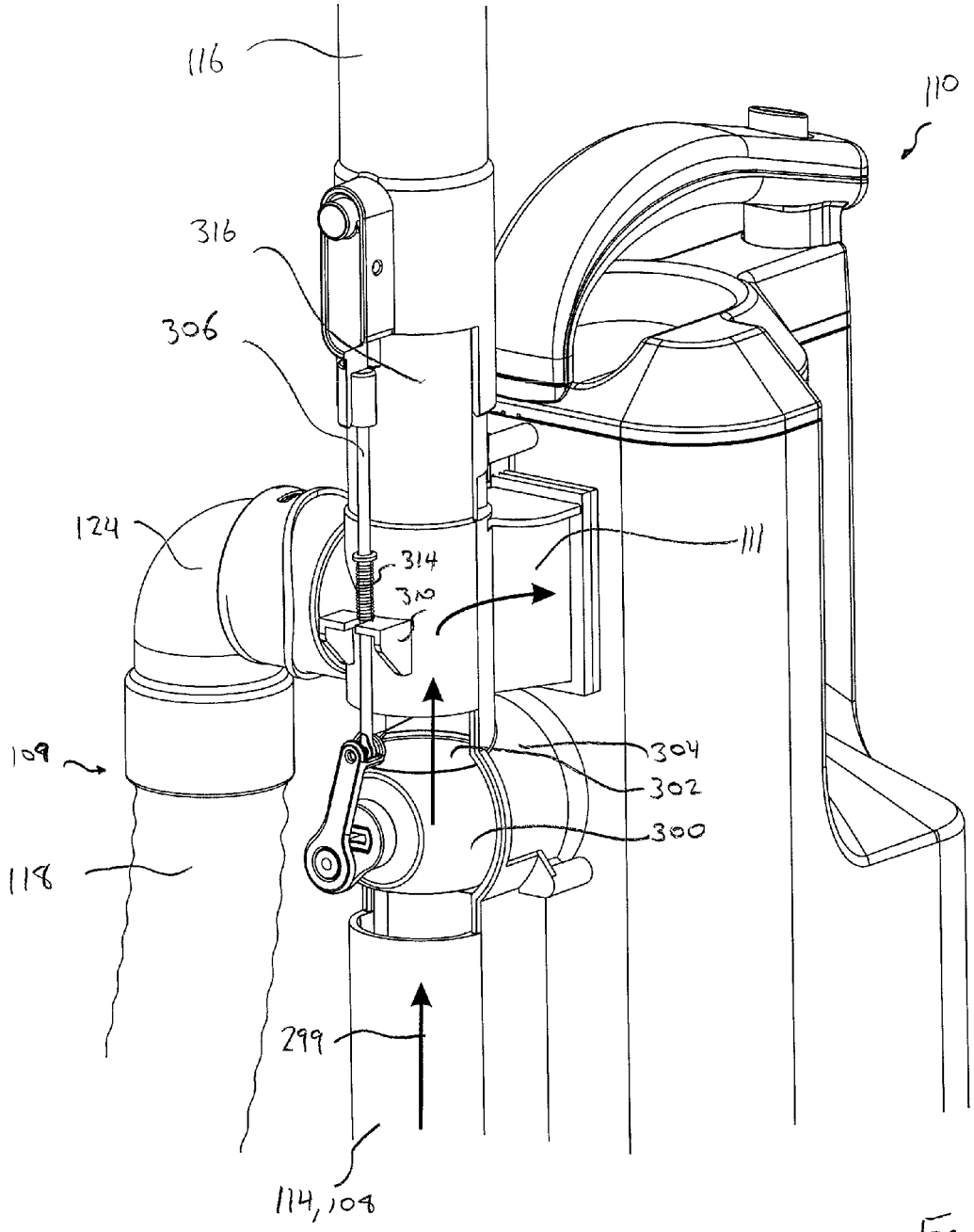
FIG. 10 is the enlarged view of FIG. 8 with the valve in an open position.
Figure 11:
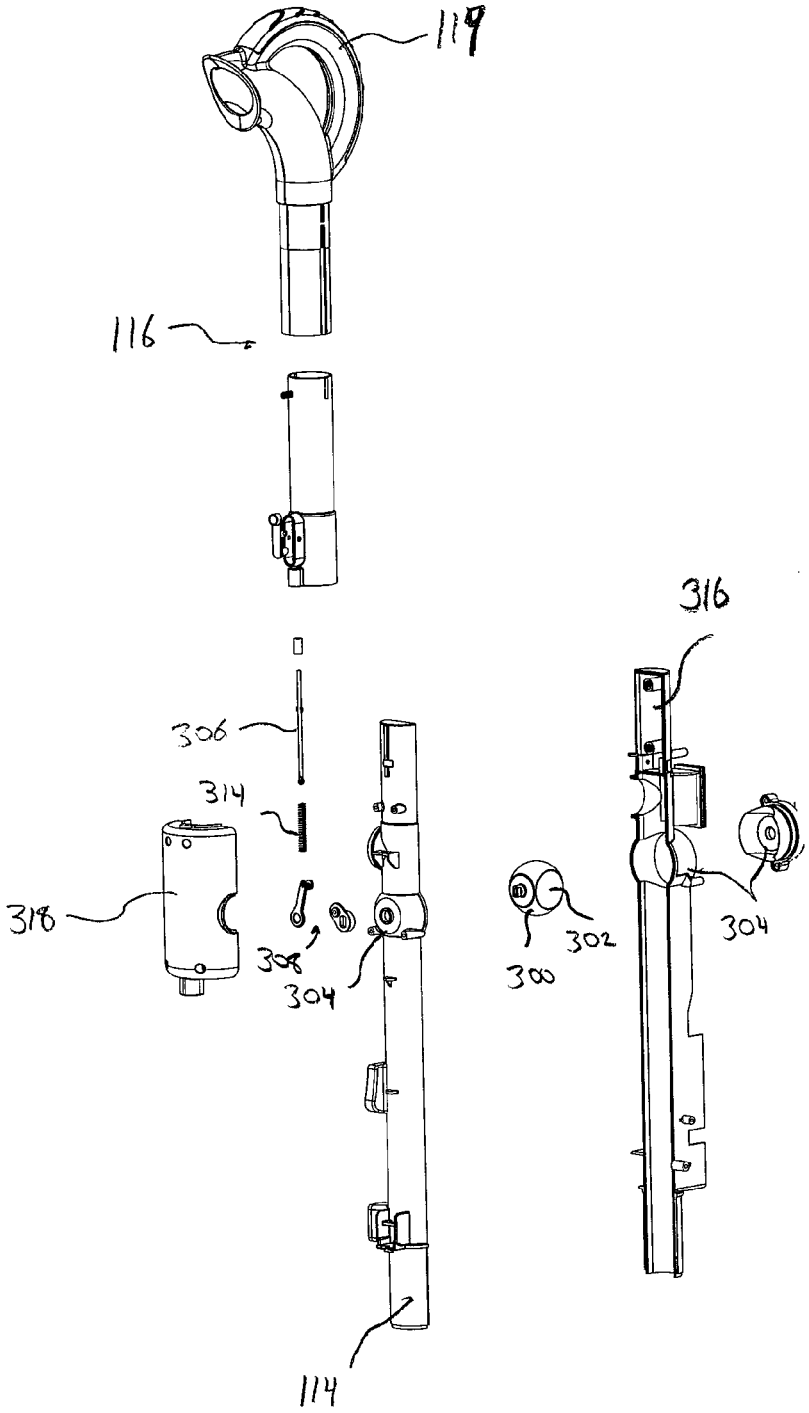
FIG. 11 is a partially exploded view of the portion of the cleaning apparatus of FIG. 8.

When the surface cleaning apparatus is operated in an above floor cleaning mode, the upper upflow conduit 116 is removed from the mount 316 and manipulated by the user. Dirt and debris entrained in dirty air, represented by arrows 299 in FIG. 9, are sucked in through dirty air inlet 103 and carried along air flow path 109 (for example through upper upflow duct 116 and flexible hose 118) into cleaning unit inlet 111.

When the upper upflow duct 116 is removed from the mount 316 it no longer exerts a downward force on linkage rod 306. In the absence of a downward force, the biasing force of the spring 314 urges the linkage rod 306 upwards, which moves lever 308 and rotates valve 300 into the closed position. In this configuration air flow path 108 is substantially blocked, preventing dirt and debris from being sucked in through dirty air inlet 102 and concentrating the available vacuum suction through air flow path 109. In some examples, the conduits forming air flow path 109 may have a larger diameter than conduits forming air flow path 108. Also, air flow path 109 is free from the equipment and relatively tight air flow passages contained within the surface cleaning head 106. Accordingly, upper upflow conduit 116 may be selected by a user to suck up larger, bulkier particles and objects. Providing the flow directing valve 300 in the floor cleaning air flow path 108 and not in the above floor cleaning air flow path 109 enables the air flow path 109 to remain generally free of restrictions and obstacles, and prevents large objects sucked in through dirty air inlet 103 from having to pass the through central bore 302 of the valve 300.

When the user is finished using the upper upflow duct 116 as an above floor cleaning device, the upper upflow duct 116 can be re-connected to mount 314 for storage, thereby sealing dirty air inlet 103 and opening valve 300. With the upper upflow duct 116 re-connected, the user can continue to operate the surface cleaning apparatus 100 in a floor cleaning mode, or position the upper section 101 in a storage position, as exemplified in FIG. 1, if no additional cleaning is required.

In other examples, the position of the valve 300 can be manually controlled by a user and may not be dependent on the configuration or operating mode of the surface cleaning apparatus 100.

Various apparatuses or methods are described above to provide an example of each claimed invention. No example described above limits any claimed invention and any claimed invention may cover processes or apparatuses that are not described above. The claimed inventions are not limited to apparatuses or processes having all of the features of any one apparatus or process described above or to features common to multiple or all of the apparatuses described above.

The invention claimed is:

1. An upright surface cleaning apparatus operable in a floor cleaning mode and an above floor cleaning mode, the upright surface cleaning apparatus comprising:

(a) a floor cleaning head having a dirty air inlet;

(b) an upper section comprising a handle drivingly connected to the floor cleaning head;

(c) a first upstream air flow path extending from the dirty air inlet of the floor cleaning head to a downstream air flow path and having an outlet end;

(d) an above floor cleaning member removably mounted to the surface cleaning apparatus and comprising an alternate dirty air inlet wherein, the alternate dirty air inlet of the above floor cleaning member is closed when the above floor cleaning member is placed in a storage position on the upright surface cleaning apparatus;

(e) a second upstream air flow path extending from the dirty air inlet of the above floor cleaning member to the downstream air flow path, the second upstream air flow path comprises a hose having an outlet end;

(f) the downstream air flow path including an air treatment member and a suction motor and extending from each upstream air flow path to a clean air outlet;

(g) a valve operable to selectively connect the first upstream air flow path in flow communication with the downstream air flow path; and, (h) an actuator external to the downstream air flow path and operably connected to the valve, the above floor cleaning member drivingly engaging the actuator when the above floor cleaning member is placed in the storage position, whereby, when the above floor cleaning member is placed in the storage position, the actuator drivingly operates the valve to connect the first upstream air flow path in flow communication with the downstream air flow path.

2. The upright surface cleaning apparatus of claim 1 wherein the valve is operable between an open position in which the first upstream air flow path is in flow communication with the downstream air flow path and a closed position in which the first upstream air flow path is isolated from flow communication with the downstream air flow path and the outlet end of the hose is open when the above floor cleaning member is in the storage position and remain in flow communication with the downstream air flow path regardless of the position of the valve.

3. The upright surface cleaning apparatus of claim 1 wherein the dirty air inlet of the above floor cleaning member is sealed by a non-moveable member when the above floor cleaning member is placed in the storage position.

4. The upright surface cleaning apparatus of claim 3 wherein the valve is operable between an open position in which the first upstream air flow path is in flow communication with the downstream air flow path and a closed position in which the first upstream air flow path is isolated from flow communication with the downstream air flow path, and the outlet end of the hose remains in flow communication with the downstream air flow path regardless of the position of the valve.

5. The upright surface cleaning apparatus of claim 1 wherein the valve comprises a bail valve.

6. The upright surface cleaning apparatus of claim 1 wherein the valve automatically closes the first air flow path when the above floor cleaning member is removed from the storage position.

7. The upright surface cleaning apparatus of claim 1 wherein the valve comprises a ball valve and the valve is selectively rotatable to isolate the air treatment member from the first upstream air flow path when the above floor cleaning member is removed from the storage position.

8. The upright surface cleaning apparatus of claim 1 wherein the valve is operable between an open position in which the first upstream air flow path is in flow communication with the downstream air flow path and a closed position in which the first upstream air flow path is isolated from flow communication with the downstream air flow path and the valve is biased to the closed position.

9. The upright surface cleaning apparatus of claim 1 further comprising a valve drive member, wherein the valve comprises a rotatable member and the valve drive member includes a lever eccentrically mounted to the valve and drivenly operated upon positioning the above floor cleaning member in the storage position.

10. The upright surface cleaning apparatus of claim 1 wherein the actuator is positioned laterally from the above floor cleaning member.

11. The upright surface cleaning apparatus of claim 1, wherein the second air flow path comprises a rigid conduit upstream of the hose, the rigid conduit having an inlet end, the inlet end of the rigid conduit having a drive member configured to drivingly engage the actuator when the above floor cleaning member is placed in the storage position.

12. The upright surface cleaning apparatus of claim 11, wherein the drive member is positioned on an outer surface of the rigid conduit.

13. The upright surface cleaning apparatus of claim 12, wherein the rigid conduit has a longitudinally extending sidewall and the drive member is positioned on the longitudinally extending sidewall.

14. The upright surface cleaning apparatus of claim 11, wherein the actuator comprises a link member external to each of the air flow paths and operable to drivingly engage the valve when the above floor cleaning member is placed in the storage position.

15. The upright surface cleaning apparatus of claim 14, wherein the link member is eccentrically mounted to the valve and drivenly operated upon positioning the above floor cleaning member in the storage position.

16. The upright surface cleaning apparatus of claim 11, wherein the actuator comprises a link member that has a first end that is engageable by the drive member and the first end is moveable in a direction of insertion of the above floor cleaning member upon insertion of the above floor cleaning member.

17. The upright surface cleaning apparatus of claim 16, wherein the link member is eccentrically mounted to the valve and drivenly operated upon positioning the above floor cleaning member in the storage position.

18. The upright surface cleaning apparatus of claim 11, wherein the actuator comprises a link member that is moveable in a direction of insertion of the above floor cleaning member upon insertion of the above floor cleaning member.

19. The upright surface cleaning apparatus of claim 18, wherein the link member is eccentrically mounted to the valve and drivenly operated upon positioning the above floor cleaning member in the storage position.

* * * * *